US005355078A

United States Patent [19]

Demizu

[11] Patent Number: 5,355,078

[45] Date of Patent: Oct. 11, 1994

[54] SEMICONDUCTOR INTEGRATED CIRCUIT FOR A STABILIZED POWER SUPPLY CIRCUIT

[75] Inventor: Hironobu Demizu, Kashihara, Japan

[73] Assignee: Sharp Kabushiki Kaisha, Osaka, Japan

[21] Appl. No.: 84,955

[22] Filed: Jul. 2, 1993

[30] Foreign Application Priority Data

Jul. 31, 1992 [JP] Japan ..... 4-205174

[51] Int. Cl.[5] ..... G05F 1/46

[52] U.S. Cl. ..... 323/281; 323/313; 323/315; 363/147; 257/467

[58] Field of Search ..... 323/281, 282, 313, 315, 323/351; 363/147; 257/467, 469

[56] References Cited

U.S. PATENT DOCUMENTS 4,524,318 6/1985 Burnham et al. ..... 323/313
4,731,574 3/1988 Melbert ..... 323/275
5,243,271 9/1993 Lommers ..... 323/279

FOREIGN PATENT DOCUMENTS 61-117613 6/1986 Japan .

*Primary Examiner*—Steven L. Stephan
*Assistant Examiner*—Adolf Berhane
*Attorney, Agent, or Firm*—Nixon & Vanderhye

[57] ABSTRACT

A stabilized power supply circuit is prevented from being affected by a heavy load. A transistor ($Q_1$) having a smaller emitter area, a transistor ($Q_2$) having a larger emitter area, and an output transistor ($Q_3$) are incorporated in an IC. The distance ($L_1$) between the first transistor ($Q_1$) and the output transistor ($Q_3$) is longer than the distance ($L_2$) between the second transistor ($Q_2$) and the output transistor ($Q_3$).

11 Claims, 4 Drawing Sheets

SEMICONDUCTOR INTEGRATED CIRCUIT FOR A STABILIZED POWER SUPPLY CIRCUIT

BACKGROUND OF THE INVENTION

This invention relates to an improvement of a semiconductor integrated circuit for a stabilized power supply circuit which is required to stably supply a voltage even when a load is largely changed in level.

FIG. 5 is a block diagram of a stabilized power supply circuit which serves as the premise of the invention.

An input voltage $V_I$ is supplied to the emitter of a FNF transistor $Q_{10}$. The output voltage $V_O$ from the collector of the transistor is applied via a resistance $R_O$ of a lead conductor to a load $R_L$ through which a load current $I_O$ flows.

A stabilized power supply circuit 3 is connected to the base of the transistor $Q_{10}$ and controls the transistor so that the output voltage $V_O$ is kept constant.

The stabilized power supply circuit 3 is incorporated in a semiconductor integrated circuit (IC).

The stabilized power supply circuit 3 comprises a reference voltage circuit 1, an error amplifier 2, an output transistor $Q_3$, potential dividing resistors $R_A$ and $R_B$, etc.

The output voltage $V_O$ of the transistor $Q_{10}$ is divided by the resistors $R_A$ and $R_B$. The intermediate voltage $V_A$ is input to a negative terminal of the error amplifier 2 which is connected to base of the output transistor $Q_3$.

The reference voltage circuit 1 receives the input voltage $V_I$ and outputs a reference voltage $V_{ref}$ which is then input to a positive terminal of the error amplifier 2. The output of the error amplifier 2 is supplied to the base of the output transistor $Q_3$.

In this way, the voltage $V_A$ which is a portion of the output voltage $V_O$ is fed back to the base of the output transistor $Q_3$, and the output transistor $Q_3$ is controlled on the basis of the difference between the reference voltage $V_{ref}$ and the voltage $V_A$ so as to stabilize the output voltage $V_O$.

FIG. 6 is a circuit diagram of an example of the reference voltage circuit 1.

The input voltage $V_I$ is coupled via a resistor $R_3$ to the collector of a transistor $Q_1$ which is connected so as to function as a diode. The emitter of the transistor $Q_1$ is grounded. The input voltage $V_I$ is coupled via a resistor $R_2$ also to the collector of a transistor $Q_2$. The emitter of the transistor $Q_2$ is grounded via a resistor $R_1$. The bases of the transistors $Q_1$ and $Q_2$ are connected to each other so that the transistors $Q_1$ and $Q_2$ constitute a current mirror circuit. When the emitter area of the transistor $Q_2$ is greater than that of the transistor $Q_1$, the base-emitter forward voltage of the transistor $Q_2$ can be made smaller than that of the transistor $Q_1$ in the case where the same emitter current flows through both the transistors.

A current mirror circuit is used in a reference voltage circuit of another type. Since transistors used in a current mirror circuit must be highly consistent with each other, an IC chip incorporating such a circuit is designed so that these transistors are disposed as close as possible to each other. In order that these transistors operate at the same temperature, furthermore, such an IC chip is designed so that these transistors are separated as equally as possible from an output transistor or the like which may serve also as a heat generating source.

FIG. 7 shows an example of such an IC of the stabilized power supply circuit 3. In the chip, the distances $L_1$ and $L_2$ between the output transistor $Q_3$ and the transistors $Q_1$ and $Q_2$ which constitute a current mirror circuit are substantially equal to each other.

Between the input voltage $V_1$ and the ground, connected is a differential amplifier which consists of transistors $Q_6$ and $Q_7$ and is connected to a current mirror circuit consisting of transistors $Q_4$ and $Q_5$. The output of the differential amplifier is supplied to the base of a transistor $Q_8$ which in turn outputs the reference voltage $V_{ref}$.

The base of the transistor $Q_6$ is connected to the collector of the transistor $Q_1$, and the base of the transistor $Q_7$ is connected to the collector of the transistor $Q_2$. The emitters of the transistors $Q_6$ and $Q_7$ are grounded.

The reference voltage $V_{ref}$ which is output from the transistor $Q_8$ is input to the positive terminal of the error amplifier 2.

Generally, the gain of the error amplifier 2 shown in FIG. 5 is not infinite. Therefore, the output voltage of the stabilized power supply circuit is varied when the load is changed in level, or lowered as the load becomes larger.

For example, it is supposed that the load current $I_O$ is changed from 0 A to 1 A in the circuit of FIG. 5, and the voltage $V_A$ is lowered from $V_A \doteq V_{ref}$ at $I_O=0$ A to $V_A=V_{ref}-10$ mV at $I_O=1$ A (in this case, $V_{ref}=1.25$ V) because the gain of the error amplifier 2 is not infinite. When $I_O=0$ A, the output voltage $V_O$ is obtained by the following expression:

$$V_0 = \frac{R_1 + R_2}{R_1} V_A \approx \frac{R_1 + R_2}{R_1} V_{ref} = 5.000\ (V) \quad (1)$$

In contrast, when $I_O=1$ A, the output voltage $V_O$ is obtained by the following expression:

$$V_0 = \frac{R_1 + R_2}{R_1} V_A \approx \frac{R_1 + R_2}{R_1} (V_{ref} - 10\text{mV}) = 4.960\ (V) \quad (2)$$

As seen from the above expressions, when the load current $I_O$ is changed from 0 A to 1 A, there arises an inconvenience that the output voltage is lowered by about 0.8%. This is indicated by a line L11 in FIG. 4 which shows the load variation characteristic of the output voltage $V_O$.

This reduction of the output voltage seems to be caused by the fact that the gain of the error amplifier 2 is not infinite.

It is not necessary to particularly consider the transistors $Q_4$, $Q_5$, $Q_6$ and $Q_7$ in FIG. 6, because the effect of the heat generating source exerted on them is smaller than that exerted on the transistors $Q_1$ and $Q_2$.

SUMMARY OF THE INVENTION

It is an object of the invention to provide a semiconductor integrated circuit for a stabilized power supply circuit in which the output voltage is prevented from lowering even in the case of a heavy load so that a stabilized voltage can be output.

The semiconductor integrated circuit for a stabilized power supply circuit according to the invention comprises: an output transistor; control means, connected to an input of the output transistor, for feeding back an output voltage to obtain a constant voltage; and a reference voltage circuit for supplying a reference voltage to the control means, wherein the reference voltage circuit has a current mirror circuit consisting of a first transistor having a relatively small emitter area and a second transistor having an emitter area which is larger than that of the first transistor, and the distance between the first transistor and the output transistor is longer than that between the second transistor and the output transistor.

According to the invention, in a reference voltage circuit of a semiconductor integrated circuit for a stabilized power supply circuit, a current mirror circuit consists of a first transistor having a relatively small emitter area and a second transistor having an emitter area which is larger than that of the first transistor, and the distance between the first transistor and the output transistor which generates a large amount of heat is set so as to be longer than that between the second transistor and the output transistor. When a relatively large current flows through the circuit and the output transistor generates heat, the temperature of the second transistor becomes higher than that of the first transistor, and the base-emitter forward voltage of the second transistor is made smaller than that of the first transistor.

In the above configuration, since the reference voltage defined by the difference between the forward voltages can be prevented from lowering, the output voltage can be prevented from lowering in the case of a heavy load.

As described above, according to the invention, the output voltage can be prevented from lowering in the case of a heavy load and a stabilized voltage can be supplied. Moreover, when the voltage drop caused in the line to the load is to be considered, it is possible to raise the output voltage.

Furthermore, according to the invention, in a stabilized power supply circuit for supplying a regulation signal for voltage regulation, to a voltage regulation circuit for regulating an input voltage and for supplying an output voltage to a load, the stabilized power supply circuit comprises:

an output transistor for outputting a constant voltage signal which functions as the regulation signal;

a reference voltage circuit for generating a predetermined reference voltage; and control means for controlling the output transistor on the basis of the difference between the reference voltage and the output voltage, the reference voltage circuit has a current mirror circuit consisting of a first transistor having a relatively small emitter area and a second transistor having an emitter area which is larger than that of the first transistor, and the distance between the first transistor and the output transistor is longer than that between the second transistor and the output transistor.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
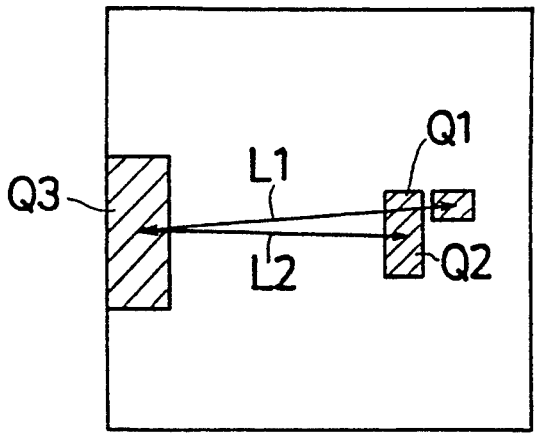
FIG. 1 is a plan view of an IC chip of an embodiment of the invention.

Now referring to the drawing, preferred embodiments of the invention are described below.

FIG. 1 is a plan view of an IC chip in which the stabilized power supply circuit 3 according to the invention is incorporated. The distance $L_1$ between the first transistor $Q_1$ constituting the current mirror circuit of the reference voltage circuit and the output transistor $Q_3$ is longer than the distance $L_2$ between the second transistor $Q_2$ constituting the current mirror circuit and the output transistor $Q_3$. The emitter area of the first transistor $Q_1$ is smaller than that of the second transistor $Q_2$.

In the case of a heavy load, the output transistor $Q_3$ generates heat and a temperature gradient is produced in the IC chip. When the junction temperatures $T_{j1}$ and $T_{j2}$ of the transistors $Q_1$ and $Q_2$ are compared to each other in this case, the junction temperature $T_{j1}$ is lower than the junction temperature $T_{j2}$ ($T_{j1} < T_{j2}$) because the transistor $Q_1$ is further separated from the transistor $Q_3$.

Figure 2A:
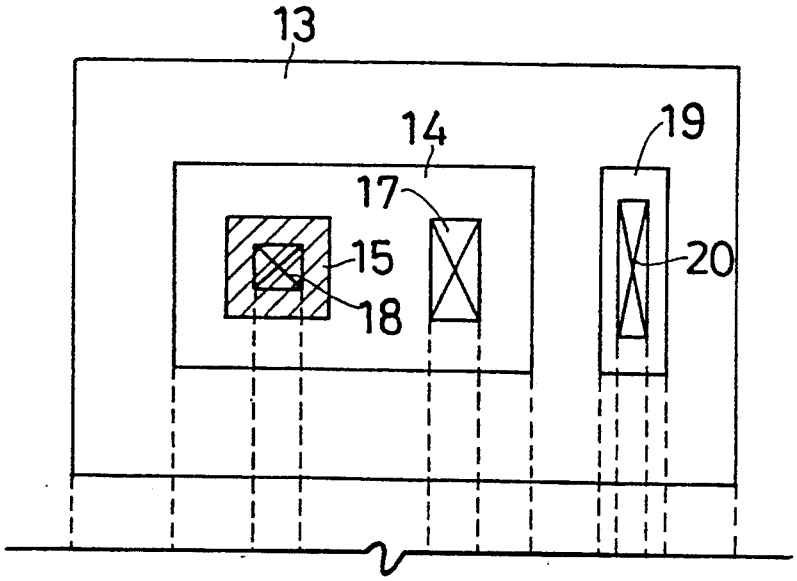
FIG. 2(1) is a plan view showing the configuration of a transistor, and FIG. 2(2) is a section view showing the configuration of the transistor.
Figure 2B:
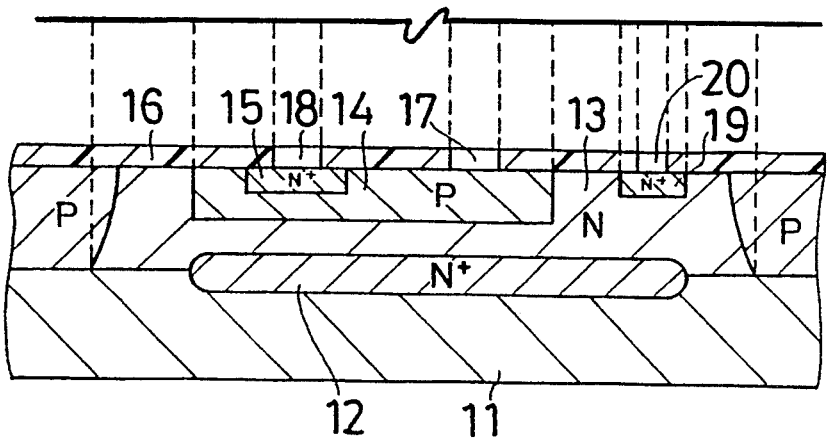

FIG. 2 shows the configuration of a transistor. FIG. 2(1) is a plan view of the transistor, and FIG. 2(2) is a section view of the transistor. An N+ buried diffusion layer 12, an N layer 13, a P layer 14, an N+ type emitter diffusion layer 15, 19, and an insulating layer 16 are formed in sequence on a substrate 11 to form the transistor. The region where the N layer 13 is formed functions as a field. A through hole 17 which is formed over the P layer 14 and in the insulating layer 16 serves as a contact. The region corresponding to a through hole 18 which is formed over the N+ type emitter diffusion layer 15 and in the insulating layer 16 is the center portion of the emitter diffusion layer. The area of the center portion constitutes the emitter area. The region corresponding to a through hole 20 which is formed over the N+ type emitter diffusion layer 15 and in the insulating layer 16 serves as a contact.

The distance between two transistors is the distance between the center portions 18 of the emitter diffusion layers of the two transistors. The junction temperature is the temperature of the emitter diffusion layer of a transistor.

Figure 3:
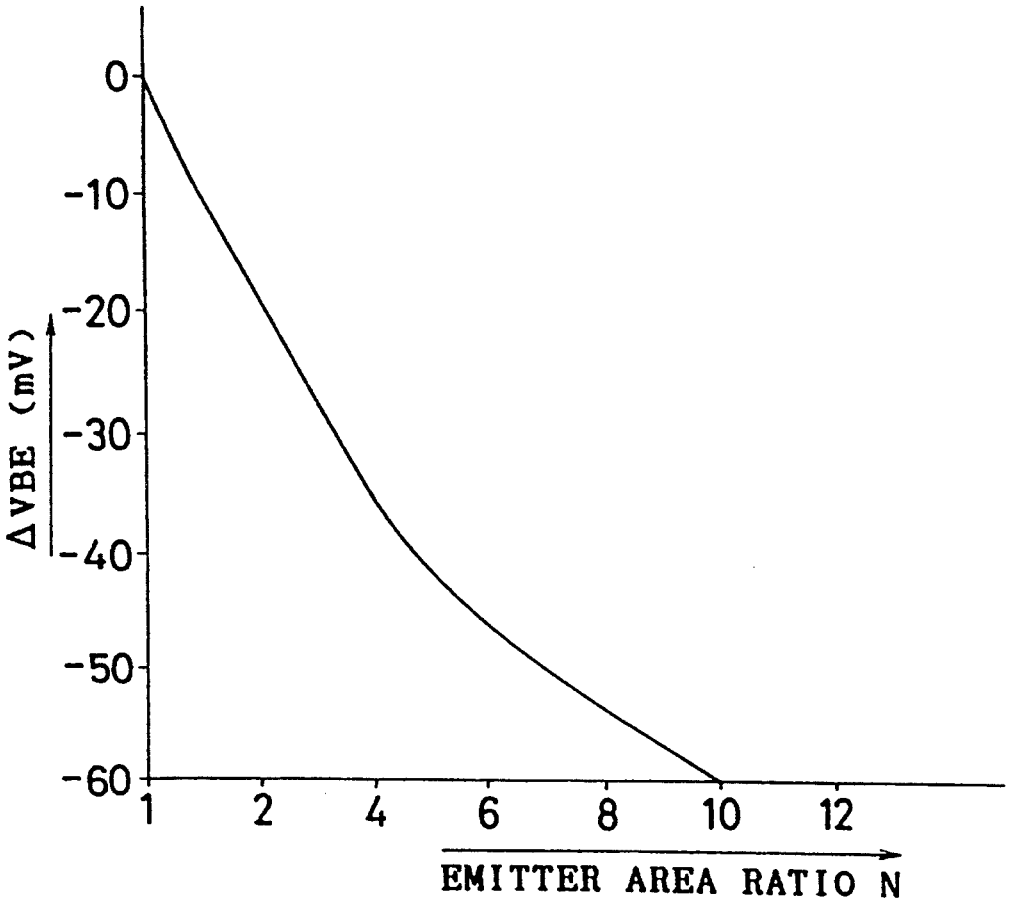
FIG. 3 is a graph showing the relationship between the forward voltage difference $\Delta V_{BE}$ and the emitter area ratio N.
Figure 4:
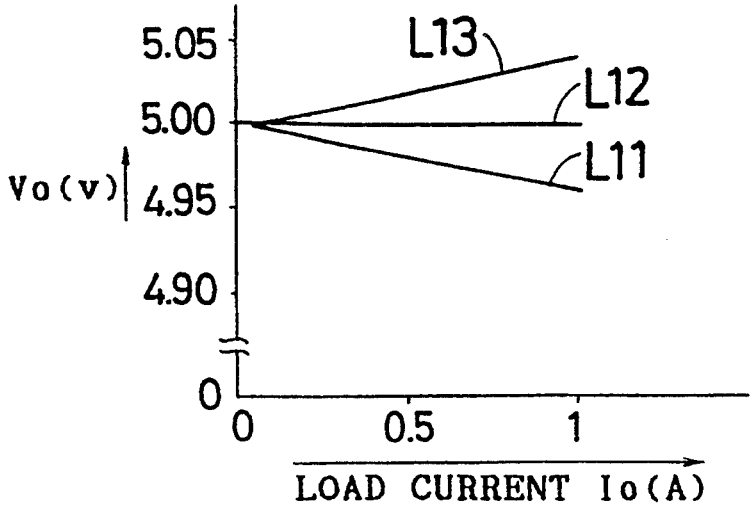
FIG. 4 is a graph showing the load variation characteristic of the output voltage $V_O$.
Figure 5:
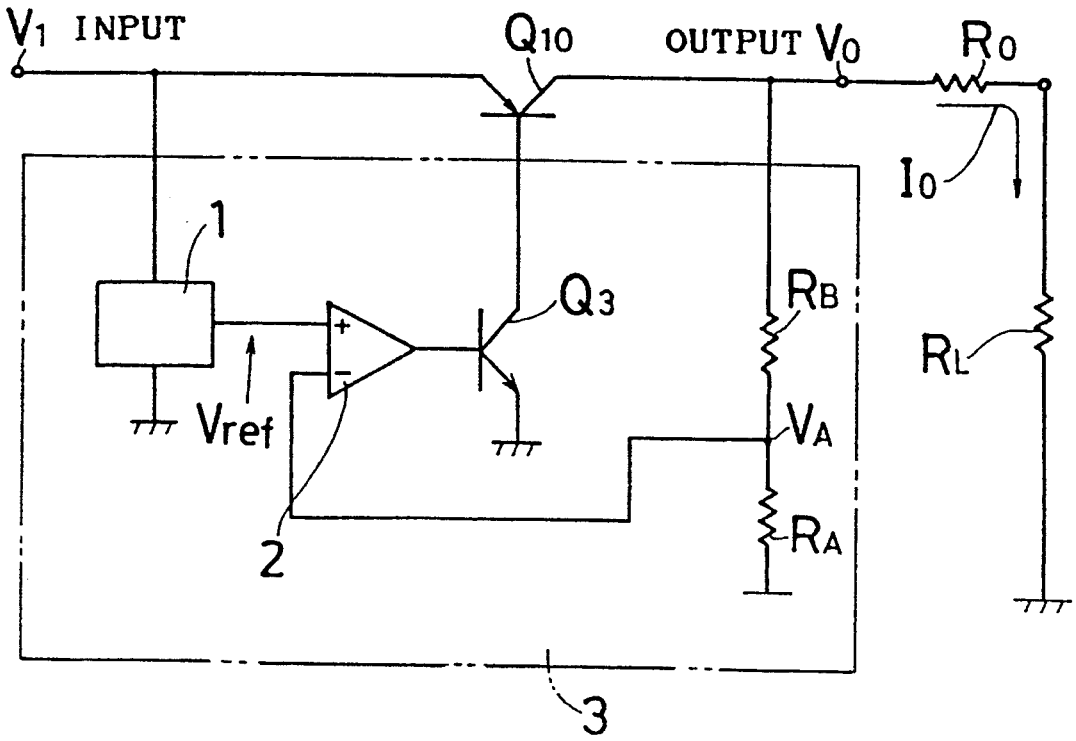
FIG. 5 is a block diagram of a stabilized power supply circuit.

Generally, as the emitter area of a transistor becomes larger, the base-emitter forward voltage $V_{BE}$ is reduced. FIG. 3 is a graph showing the relationship between the forward voltage difference $\Delta V_{BE}$ and the emitter area ratio N. Namely, the forward voltage difference $\Delta V_{BE}$ can be calculated by the following expression:

$$\Delta V_{BE} = -\frac{k \cdot T}{q} \ln N \tag{3}$$

where k is the Boltzmann's constant, T is the absolute temperature, q is the elementary charge, and N is the emitter area ratio. In FIG. 4, the forward voltage $V_{BE}$ (about 0.65 V) of a transistor having the emitter area of $20\times20=400\ \mu m^2$ is used as the reference.

Figure 6:
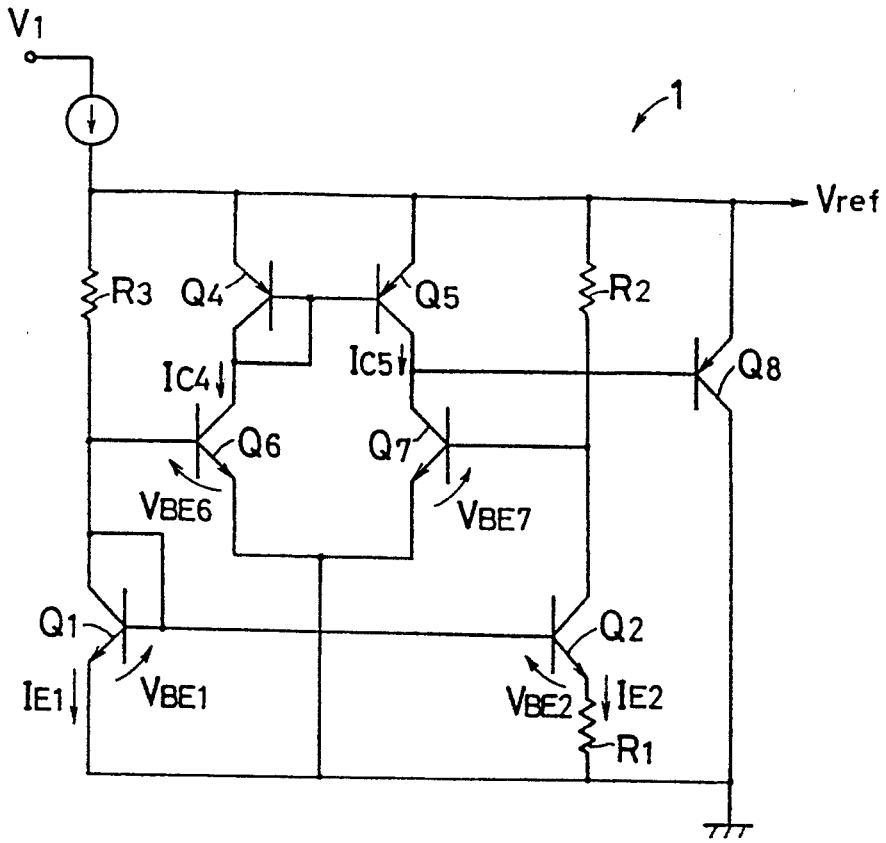
FIG. 6 is a circuit diagram of a reference voltage circuit.
Figure 7:
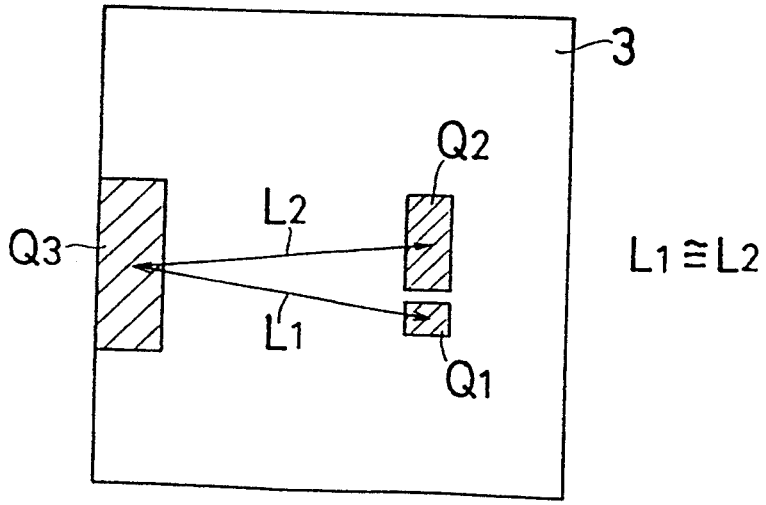
Fig.7 Prior Art
FIG. 7 is a plan view of a prior art stabilized power supply circuit.

The manner in which the reference voltage $V_{ref}$ changes will be studied with reference to FIG. 6.

In FIG. 6, the emitter currents of the transistors are designated by $I_E$, the collector currents are designated by $I_C$, and the base-emitter voltages are designated by $V_{BE}$ while adding a numeral corresponding to the number of the respective transistor. The resistor $R_1$ is 1 kΩ, and the resistors $R_2$ and $R_3$ are 10 kΩ.

The currents and voltages of the various portions of FIG. 6 have the following relationships:

$$I_{E1}=(V_{ref}-V_{BE6})/R_3 \quad (4)$$

$$I_{E2}=(V_{ref}-V_{BE7})/R_2 \quad (5)$$

Since the transistors $Q_4$ and $Q_5$ constitute a current mirror circuit, their collector currents are equal to each other ($I_{C4}=I_{C5}$), and therefore the base-emitter voltages of the transistors $Q_6$ and $Q_7$ are equal to each other ($V_{BE6}=V_{BE7}$). Since the values of the resistors $R_2$ and $R_3$ are equal to each other, the relation of $I_{E1}=I_{E2}=I_{C4}=I_{C5}$ holds. These currents are represented by $I_E$, and the base currents are neglected.

$$V_{ref}=V_{BE7}+\frac{R_2}{R_1}(V_{BE1}-V_{BE2}) \quad (6)$$

When the junction temperature of the transistor $Q_1$ is equal to that of the transistor $Q_2$ ($T_{j1}=T_{j2}$), the following is obtained:

$$V_{BE1}-V_{BE2}=\frac{kT}{q}\ln\frac{I_E}{I_S}-\frac{kT}{q}\ln\frac{I_E}{10I_S} \quad (7)$$

where $I_S$ is the reverse saturation current, k is the Boltzmann's constant, T is the absolute temperature, and q is the elementary charge.

The ratio of the emitter area of the transistor $Q_1$ to that of the transistor $Q_2$ is 1:10.

In contrast, when the junction temperature of the transistor $Q_1$ is lower than that of the transistor $Q_2$ ($T_{j1}<T_{j2}$), the forward voltage difference ($V_{BE1}-V_{BE2}$) is increased. The temperature characteristic of the forward voltage is about −2 mV/°C. When it is assumed that the junction temperature $T_{j2}$ of the transistor $Q_2$ is higher than the junction temperature $T_{j1}$ of the transistor $Q_1$ by 1° C., therefore, the forward voltage difference ($V_{BE1}-V_{BE2}$) is increased by about 2 mV. When this value is substituted in expression (6), the second term of the right side is increased, resulting in that the reference voltage $V_{ref}$ is raised. When the raise of the reference voltage is indicated by $\Delta V_{ref}$, it is obtained as follows:

$$\Delta V_{ref}=\frac{R_2}{R_1}\times 2\text{mV}=10\times 2\text{mV}=20\text{mV} \quad (8)$$

Namely, in the case of a heavy load at which a temperature gradient is produced in the IC chip, the reference voltage $V_{ref}$ is raised.

When this is applied to expression (2) of the prior art, the output voltage $V_O$ is raised in accordance with the reference voltage $V_{ref}$.

This prevents the reduction of the output voltage in a heavy load in the prior art from occurring. Furthermore, when the distances $L_1$ and $L_2$ between the output transistor $Q_3$ and the transistors $Q_1$ and $Q_2$ are adequately adjusted, the load variation of the output voltage $V_O$ can be suppressed to a small degree. This state is indicated by a line L12 in FIG. 4.

In the case where a lead wire to the load is so long that the voltage drop in the case of a heavy load cannot be neglected, or where the voltage drop due to the contact resistance at the collector portions cannot be neglected, it is preferable to modify the circuit so that the output voltage $V_O$ is raised in the case of a heavy load so as to apply a predetermined voltage to the load $R_L$. This modification can be achieved by making the distance $L_1$ further longer than the distance $L_2$. This state is indicated by a line L13 in FIG. 4.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A semiconductor integrated power supply circuit, comprising:

an output transistor for receiving an input voltage and generating an output voltage;

a reference voltage circuit also receiving the input voltage for supplying a reference voltage including a current mirror with a first transistor and a second transistor, the second transistor having an emitter area larger than that of the first transistor, wherein a first distance between the first transistor and the output transistor across the surface of the integrated circuit is greater than a second distance between the second transistor and the output transistor; and a controller for determining a difference between the reference voltage and a feed back signal proportional to the output voltage for controlling the output transistor based on the difference such that the output transistor generates a substantially constant output voltage independent of load changes.

2. The semiconductor integrated power supply circuit according to claim 1, wherein the controller includes a differential amplifier for determining the difference.

3. The semiconductor integrated power supply circuit according to claim 1, wherein the output, first, and second transistors are bipolar junction type transistors (BJT) and the controller includes a third BJT transistor having its base terminal connected to the difference signal and its collector terminal connected to the base terminal of the output transistor.

4. The semiconductor integrated power supply circuit according to claim 1, wherein when the output transistor is designed to supply voltage to heavy loads, the first distance is substantially greater than the second distance.

5. The semiconductor integrated power supply circuit according to claim 1, wherein when a load is applied to the output transistor, a temperature gradient is generated in the semiconductor integrated power supply circuit which, because of the current mirror relationship between the first and second transistors, causes the reference voltage to increase which prevents the output voltage from decreasing upon application of the load.

6. The semiconductor integrated power supply circuit according to claim 1, wherein the ratio of the emitter areas of the first and second transistors is on the order of 1:10.

7. A stable power supply circuit for regulating an input voltage and supplying a constant output voltage to a load, comprising:

an output transistor for receiving the input voltage and generating the output voltage;

a reference voltage circuit also receiving the input voltage for supplying a reference voltage including a current mirror with a first transistor and a second transistor having an emitter area larger than that of the first transistor, wherein a first distance between the first and output transistors across the surface of the integrated circuit is greater than a second distance between the second and output transistors; and a controller for and controlling the output transistor based on the difference between a feed back signal from the output voltage and the reference voltage such that the output transistor generates a substantially constant output voltage despite load changes.

8. A semiconductor integrated circuit, comprising on the same semiconductor chip:

an output transistor for receiving an input voltage and providing an output voltage to a load in response to a control signal, and a current mirror circuit, receiving the input voltage and outputting a reference voltage used in generating the control signal, including first and second bipolar junction transistors, the second transistor having an emitter surface area on the chip larger than the surface area of the first transistor and the distance between the first and output transistors being greater than that between the second and output transistors, wherein as the load on the output transistor increases, a first junction temperature between the output and first transistors decreases relative to a second junction temperature between the output and second transistors thereby decreasing the base-emitter voltage of the second transistor relative to the baseemitter voltage of the first transistor such that the reference voltage increases in response to the increased load.

9. The semiconductor device according to claim 8, further comprising:

a differential amplifier for determining a difference between the reference voltage and a signal proportional to the output voltage, wherein the difference is applied as the control signal to the output transistor.

10. The semiconductor device according to claim 9, wherein the increase in reference voltage prevents a decrease in output voltage in response to the increased load.

11. The semiconductor integrated power supply circuit according to claim 8, wherein the ratio of the emitter areas of the first and second transistors is on the order of 1:10.

* * * * *